US007201411B2

(12) United States Patent
Bella et al.

(10) Patent No.: US 7,201,411 B2
(45) Date of Patent: Apr. 10, 2007

(54) PUSH LATCH

(75) Inventors: Joseph J. Bella, Plainfield, IL (US); Steven L. Bivens, Kankakee, IL (US); Martin A. Witt, Tinley Park, IL (US)

(73) Assignee: Illinois Tool Works Inc, Glenview, IL (US)

( * ) Notice: Subject to any disclaimer, the term of this patent is extended or adjusted under 35 U.S.C. 154(b) by 76 days.

(21) Appl. No.: 11/172,632

(22) Filed: Jul. 1, 2005

(65) Prior Publication Data

US 2006/0103140 A1 May 18, 2006

Related U.S. Application Data

(60) Provisional application No. 60/629,043, filed on Nov. 18, 2004.

(51) Int. Cl.
*E05B 3/00* (2006.01)

(52) U.S. Cl. ..... 292/336.3; 292/DIG. 4; 292/DIG. 37

(58) Field of Classification Search ..... 292/336.3, 292/DIG. 37, DIG. 4
See application file for complete search history.

(56) References Cited

U.S. PATENT DOCUMENTS 2,989,333 A * 6/1961 Fox ..... 292/280
6,106,036 A * 8/2000 Okada et al. ..... 292/336.3
6,719,337 B1 * 4/2004 Ji ..... 292/341.17
6,966,583 B2 * 11/2005 Ji et al. ..... 292/231

* cited by examiner

*Primary Examiner*—Gary Estremsky
(74) *Attorney, Agent, or Firm*—Mark W. Croll; Paul F. Donovan

(57) ABSTRACT

A push latch that may be used in automobile applications to open and close compartment doors or bins reduces the number of components typically found in prior art designs while retaining the same quality and function. The push latch of the invention further eliminates the use of metal pins and springs, provides an assembly that is easier to assemble and reduces the cost to manufacture. In one embodiment, the push latch generally includes the use of a housing, lock and button. The lock includes the use of a flexible spring arm and bosses, which will engage with cam slots in the button. In operation, when the button is pushed, the cam slots will force the bosses and the lock downward causing the release of the compartment door. When the button is released, the flexible spring arm forces the cylindrical bosses upward in the cam slots thus forcing the button and lock back to their original positions.

19 Claims, 6 Drawing Sheets

PUSH LATCH

CROSS REFERENCE TO RELATED APPLICATIONS

This Non-Provisional Application claims benefit to U.S. Provisional Application Ser. No. 60/629,043 filed Nov. 18, 2004

FIELD OF THE INVENTION

The present invention relates generally to push latches and more specifically to push latches that may be used in automobile applications for glove boxes, cup holders, receptacle bins, and the like.

BACKGROUND OF THE INVENTION

It is known that push latches are used in automobiles to open and close compartments such as glove boxes, cup holders and receptacle bins. Many of these known latch mechanisms use a "push-push" configuration. With this configuration, the mechanism becomes latched by a pushing action from the user, and becomes unlatched by a similar or identical pushing motion. Other latch mechanisms use a "push-release" configuration. With this configuration, the mechanism is latched and becomes unlatched by a pushing and releasing action from the user. One known push latch includes a button, a housing adapted to receive the button, a metal lock pin operatively coupled to the button and a metal spring adapted to bias the lock pin into a locked position. Although this prior design has proven useful in certain applications, it is rather cumbersome to assemble given the relatively large number and nature of the various components. Indeed, unless assembled very carefully, the lock pin can prematurely fall out of the overall assembly, thereby requiring the assembler to start all over again. This added complexity has resulted in a higher cost assembly.

The present invention addresses this problem as well as other problems of the prior art with respect to known push latches.

SUMMARY OF THE INVENTION

The present invention is directed to a push latch that reduces the number of components typically found in prior art designs while retaining the same quality and function. The push latch of the invention also eliminates the use of metal pins and springs; provides an assembly that is easier to assemble and reduces the cost to manufacture. In an exemplary embodiment, the push latch includes the use of three general components, namely, a housing, a lock and a button. The lock includes the use of a flexible spring arm and bosses, which will engage with cam slots in the button. In a general operation, when the button is pushed, the cam slots will force the bosses and the lock downward causing the release of the compartment door. When the button is released, the flexible spring arm forces the cylindrical bosses upward in the cam slots thus forcing the button and lock back to their original positions.

Other features and advantages of the invention will become apparent to those skilled in the art upon review of the following detailed description, claims and drawings in which like numerals are used to designate like features.

Figure 1:
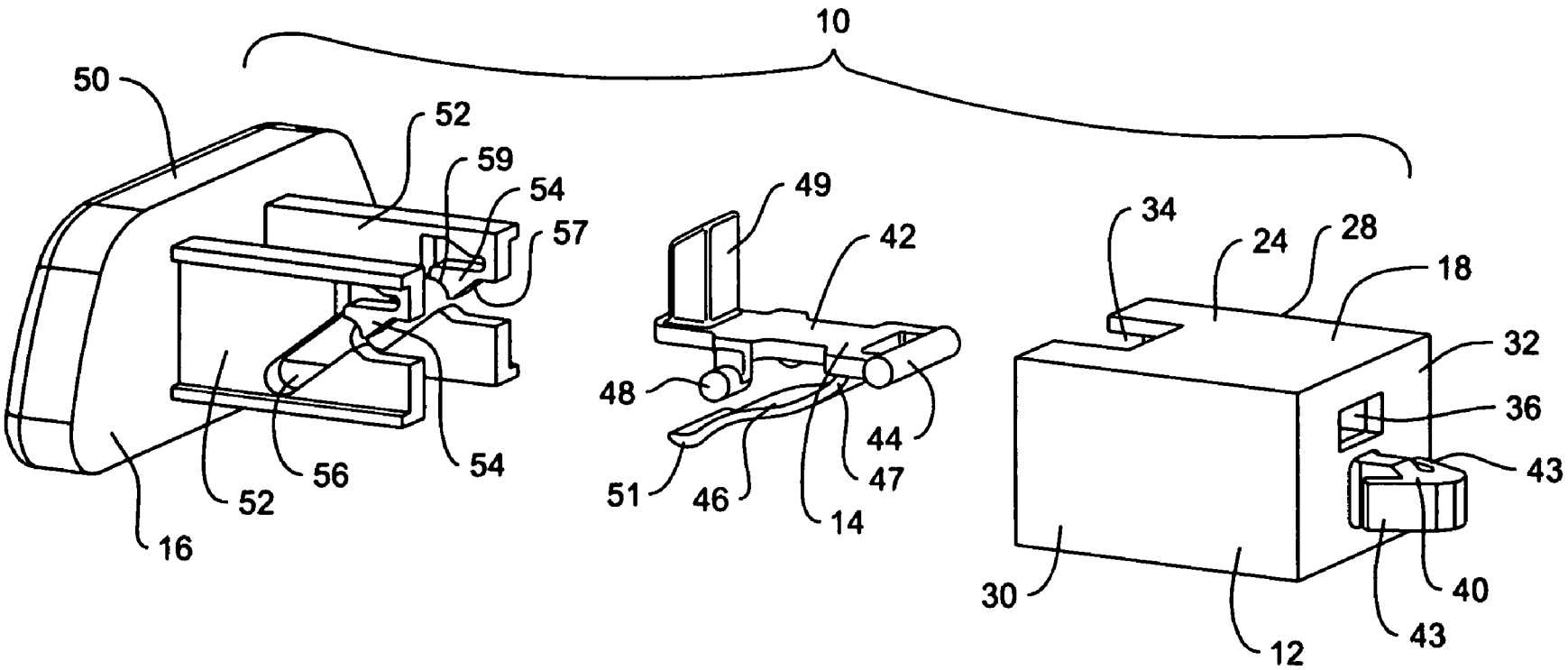
FIG. 1 is an isometric exploded view of an exemplary embodiment of a push latch of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

Figure 2:
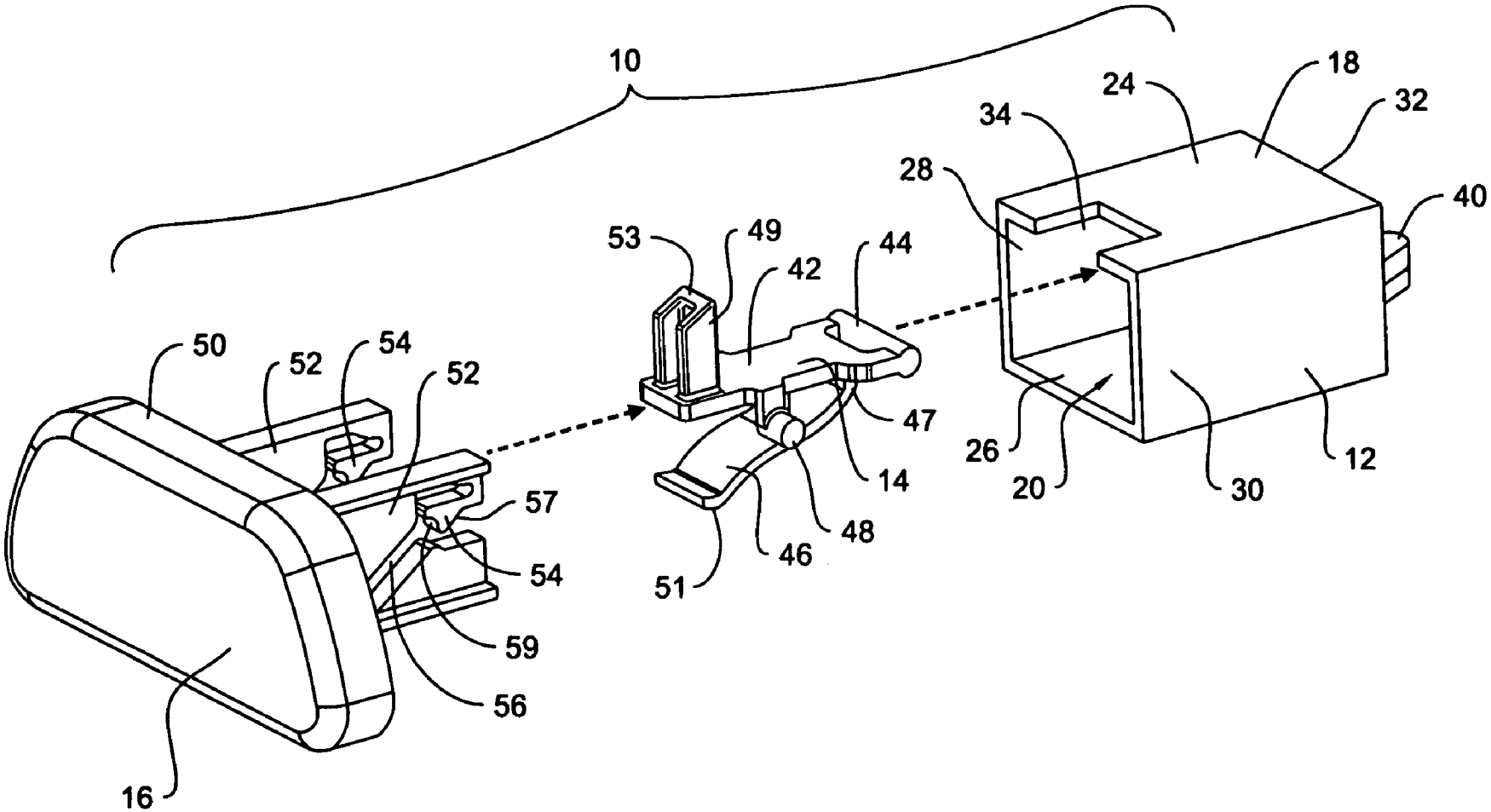
FIG. 2 is another isometric exploded view of an exemplary embodiment of a push latch of the present invention.
Figure 3B:
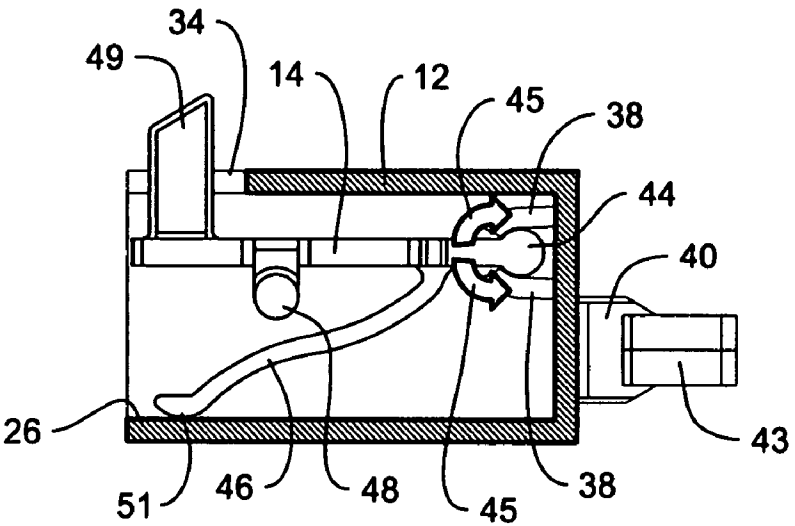
FIG. 3*b* is a cut-away side view of the assembled lock and housing of FIG. 3*a*.
Figure 3A:
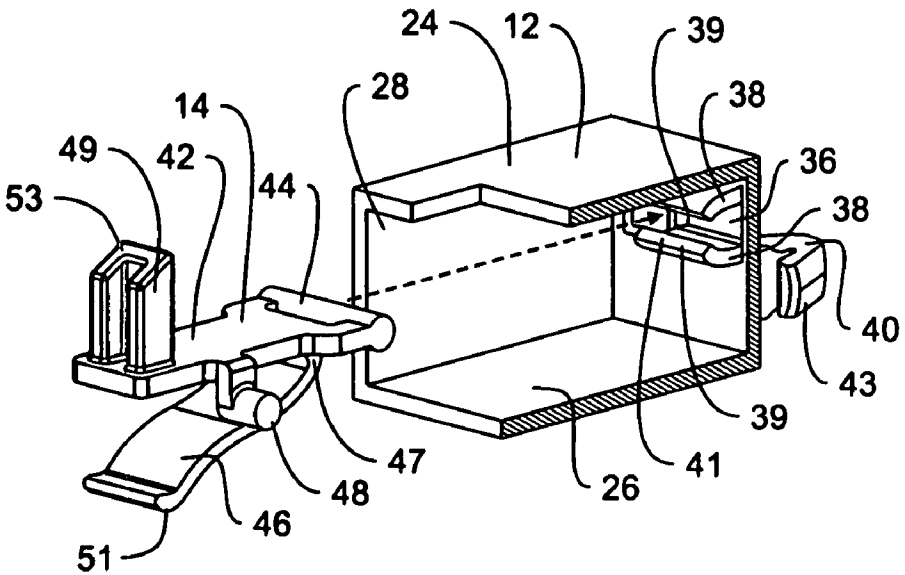
FIG. 3*a* is an isometric cut-away view of the mounting of the exemplary lock to the exemplary housing of the push latch of FIG. 1.

Referring to FIGS. 1 and 2, an exploded view of an exemplary embodiment of the push latch 10 of the invention is depicted and includes an exemplary housing 12, a lock 14, and a button 16. The structure and relationship of these exemplary components are described below. The exemplary housing 12 defines a box shaped housing body 18 made from a plastic or other suitable material. The housing body 18 forms a cavity 20 defined by a top wall 24, a bottom wall 26, a first side wall 28, a second side wall 30, and a back wall 32. The top wall further defines a notch 34 through which extends a lock boss 49, as described below. The back wall 32 defines an opening 36. Referring to FIG. 3*a*, positioned on opposing sides of the opening 36 and extending into the cavity 20 are snaps or flexible retaining members 38. The snaps 38 serve to mount the lock 14 to the housing, as described below, and permit pivotal movement of the lock 14 within the housing. The snaps 38 extend in a generally parallel manner and define opposing ends 39 that extend toward each other to hold a cylindrical rod 44 of the lock 14 between the snaps 38, as illustrated in FIG. 3*b*. The ends 39 further define inclined surfaces 41 that facilitate the insertion of the cylindrical rod 44 of the lock 14.

Referring back to FIGS. 1 and 2, extending outwardly from the back wall 32 is a mounting member 40 that serves to snap-fit the housing 12 to a mounting surface such as a wall member within the automobile. The mounting member 40 includes flexible fingers 43 that upon the insertion of the mounting member 40 into a mating hole or opening, not shown, will flex to permit the mounting member to pass through the hole or opening and will snap back to their original position after the mounting member 40 has been fully inserted. Once in this position, the flexible fingers 43 will contact the back side of the mounting surface to restrain the housing 12 to the mounting surface and to prevent the housing 12 from being pulled back out of the mating hole or opening in the mounting surface. One skilled in the art will understand that other suitable mounting members or techniques may be used to mount the invention onto an interior wall of an automobile, or onto any other wall or surface where it is desirable to mount the present invention.

Referring to FIGS. 1–3*b*, the exemplary lock 14 is formed from a plastic or other suitable material and defines a relatively planar lock body 42 forming a cylindrical rod 44 at one end. As assembled, the cylindrical rod 44 snap fits into the snaps or retaining members 38, as illustrated by FIGS. 3*a* and 3*b*. Once snap-fit into position, the lock 14 may pivot within the snaps 38 and about the cylindrical rod 44, as illustrated by the direction arrows 45 (FIG. 3*b*). Extending angularly outwardly from the lock body 42 is a flexible spring arm 46. The spring arm 46 is connected to the lock body 42 at end 47. As shown in FIG. 3*b*, the spring arm 46 defines a curvilinear shape and a free end 51 that contacts the inside of the bottom wall 26 of the housing 12. During the operation of the push latch 10, the spring arm 46 permits the lock body 42 to pivot about the cylindrical rod 44 and within the snaps 38 of the housing 12. The spring arm 46 also biases the lock body 42 back to its original position. The biasing is accomplished by the spring arm 46 flexing and the free end 51 sliding along the inside of the bottom wall 26 of the housing. The spring arm 46 may define various shapes and configurations that permit the biasing of the lock body 42 within the housing.

Referring to FIGS. 1 and 2, extending outwardly and below the lock body 42 are two opposing cylindrical bosses 48 that will each engage a mating cam slot 56 formed in the button 16. The cylindrical bosses 48 will each slide along the cam slots 56, as described below. The bosses 48 may define other shapes and configurations that permit slidable movement along the cam slot 56.

At the end of the lock body 42 opposite the cylindrical rod 44 is a lock boss 49 which extends outwardly and above the lock body 42. The lock boss 49 defines a U-shaped body having a tapered end 53. The lock boss 49 serves to restrain the compartment door or bin in a closed position, not shown. As described below, as the lock boss 49 is pulled downward and into the housing, the lock boss 49 will move away from the compartment door or bin, thereby permitting the opening of the compartment door or bin. As the door or bin is moved to a closed position, the door or bin will contact the tapered end 53 and slide along the tapered end 53, thereby urging the lock boss 49 downward into the housing 12 and away from the compartment or bin to permit the compartment door or bin to move to the closed position.

Figure 4B:
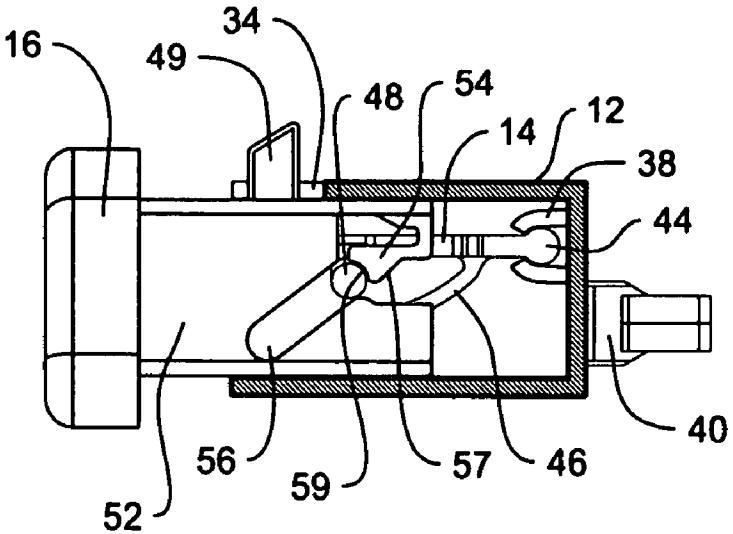
FIG. 4*b* is a cut-away side view of the assembled button, lock and housing of FIG. 4*a*.
Figure 4A:
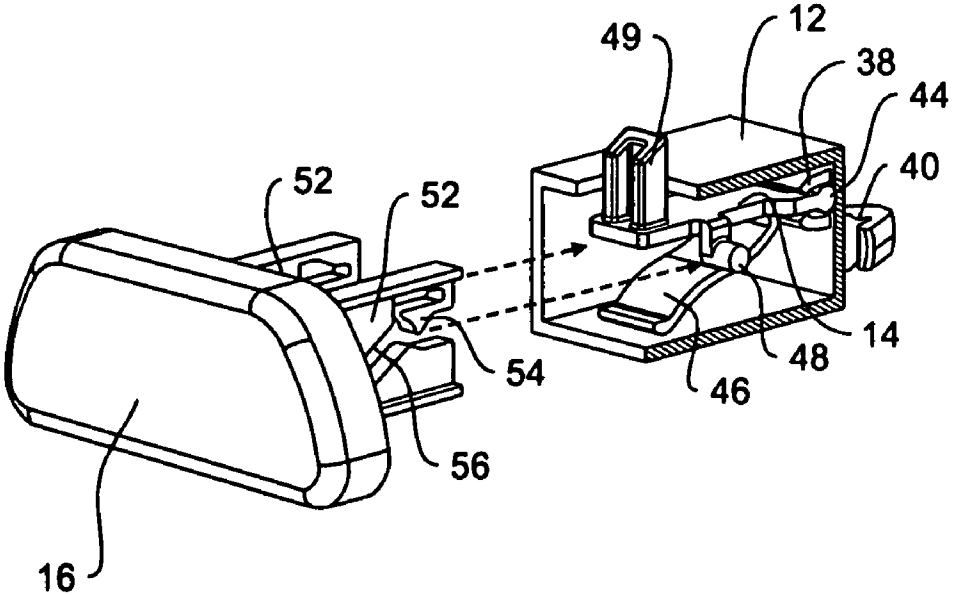
FIG. 4*a* is an isometric cut-away view of the mounting of the exemplary button to the exemplary lock and housing assembly of FIG. 3*b*.

Referring to FIGS. 1 and 2, the exemplary button 16 defines a button body 50 and a pair of outwardly extending arms 52. The button body 50 may be made of a plastic or other suitable material and may define numerous shapes and configurations. Each arm 52 extends outwardly from the button body 50. Each arm 52 defines a snap 54 and a cam slot 56 that receive the cylindrical bosses 48 of the lock 14. The snap 54 is formed as a downwardly extending flexible finger that will permit the cylindrical boss 48 to pass into the cam slot 56 and yet prevent the cylindrical boss 48 from backing out of the slot 56. The snap 54 further defines an angled surface 57 that when contacted by the boss 48 will cause the snap 54 to flex, thereby permitting the boss 48 to pass by the snap 54. The snap 54 also defines a curved-shape recess portion 59 that, as illustrated in FIG. 4*b*, will function as a stop to contain the boss 48 within the slot 56 and to prevent the boss 48 from traveling back out of the slot 56 and thus preventing the button 16 from falling or being pulled out of the housing 12.

The cam slots 56 are configured as inclined slots and are sized and shaped to receive the cylindrical bosses 48. As explained below, as the button 16 is pushed, the cam slots 56 act on the cylindrical bosses 48 effecting movement of the cylindrical bosses 48 along the slots 56.

Figures 5A, 5B, 5C:
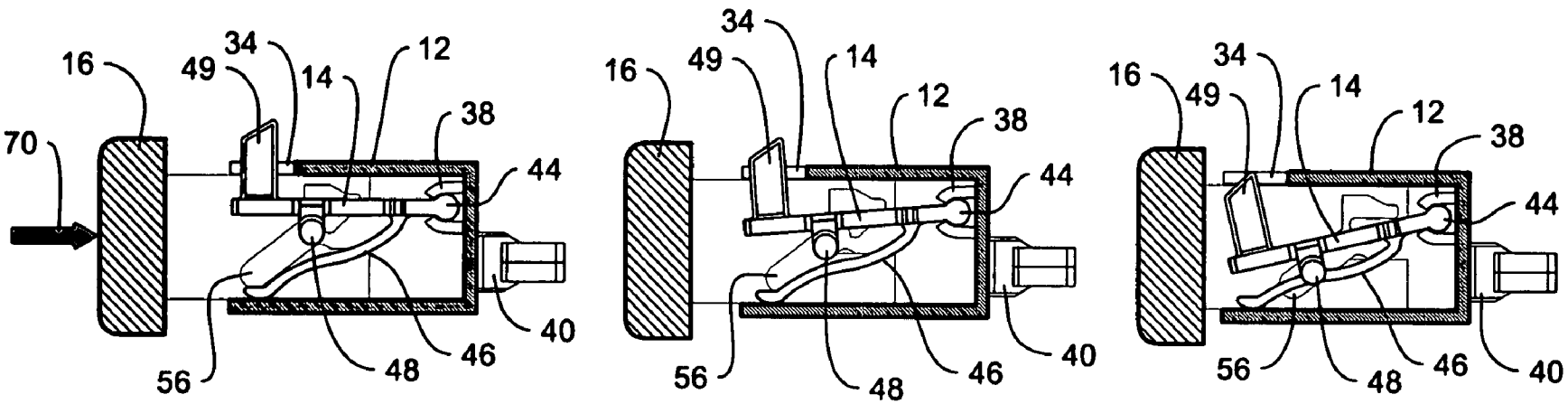
FIG. 5*a* depicts a cut-away side view of an opening operation position of the push latch.
FIG. 5*b* depicts a cut-away side view of another opening operation position of the push latch.
FIG. 5*c* depicts a cut-away side view of another opening operation position of the push latch.

FIGS. 5*a*–*c* and 6*a*–*c* depict several positions of the push latch 10 operation. Referring to FIGS. 5*a*–*c*, when the button 16 is pushed, as by direction arrow 70, the cam slots 56 on the arms 52 of the button 16 urge the cylindrical bosses 48 on the lock 14 downward in the slots 56. As illustrated by FIGS. 5*b* and 5*c*, this causes the lock 14 to move downward in the housing and further causes the lock boss 49 to move down through the notch 34 and into the housing 12. Once the lock boss 49 has moved into the housing 12, the lock boss 49 will no longer be restraining the compartment door or bin, not shown, and thus the door or bin will be permitted to open. Also exemplified by FIGS. 5*a*–*c*, the spring arm 46 depresses to permit the downward movement of the lock boss 49 into the housing 12.

Figures 6A, 6B, 6C:
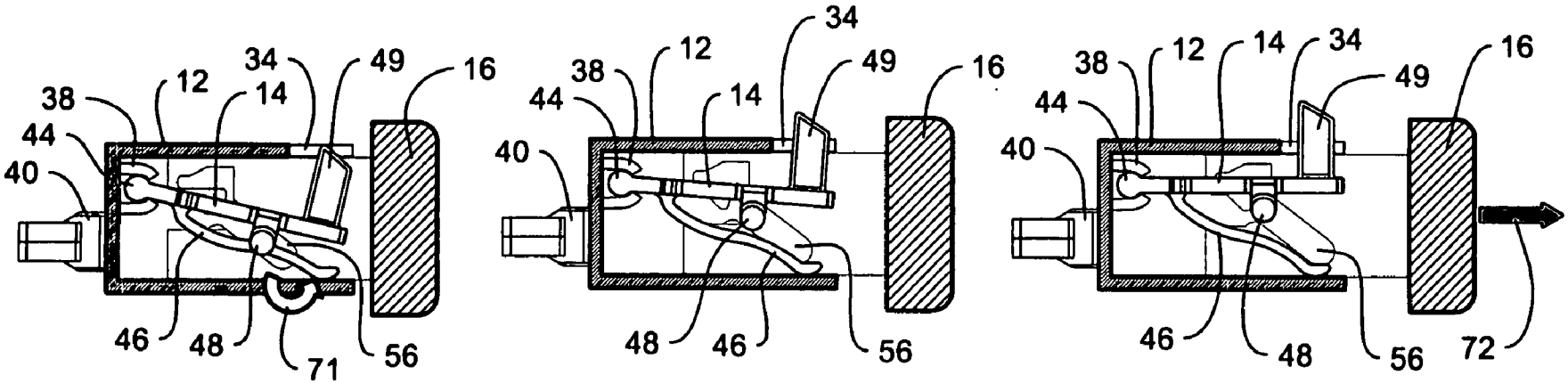
FIG. 6*a* depicts a cut-away side view of a closing operation position of the push latch.
FIG. 6*b* depicts a cut-away side view of another closing operation position of the push latch.
FIG. 6*c* depicts a cut-away side view of another closing operation position of the push latch.

As illustrated by FIGS. 6*a*–*c*, when the button 16 is released, the depressed spring arm 46 of the lock 14 biases or urges the cylindrical bosses 48 of the lock 14 upward in the cam slots 56 of the button 16. As depicted by FIGS. 6*a* and 6*b*, the depressed spring arm 46 also rotatably urges the lock boss 49 upward through the notch 34 in the housing 12, as indicated by direction arrow 71. As illustrated by FIGS. 6*b* and 6*c*, this causes the button 16 to move outward as indicated by direction arrow 72 and back to its original position. As shown by FIGS. 6*a*–*c* the rotating movement of the cylindrical rod 44 within the snaps 38 further facilitates the movement of the lock 14 and thus the operation of the push latch 10.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A push latch mechanism comprising:

a housing defining a wall, the wall having retaining members extending outward from the wall, a lock defining a lock body, the lock body defining a rod for mounting to the retaining members, a spring member extending outwardly from the lock body, at least one boss extending outwardly from the lock body, and a lock boss extending outwardly from the lock body, and a button including at least one arm member, the at least one arm member defining a slot for receiving the at least one boss, wherein the at least one arm member defines a snap member.

2. The push latch mechanism as set forth in claim 1, wherein the snap member defines a contact surface for containing the at least one boss.

3. The push latch mechanism as set forth in claim 1, wherein the button includes two arm members, each arm member defining a slot and a snap member.

4. The push latch mechanism as set forth is claim 1, wherein the housing defines a bottom wall, and wherein the spring member extends outwardly from the lock body and in contact with the bottom wall.

5. The push latch mechanism as set forth in claim 3, wherein lock body defines two opposing bosses.

6. The push latch mechanism as set forth in claim 1, wherein the housing defines a top wall and a notch formed in the top wall.

7. A push latch mechanism for use in a automobile comprising:

a housing defining a top wall, a bottom wall, and a back wall, the back wall further defining retaining members extending outwardly from the back wall, a lock defining a lock body, the lock body further defining a rod for mounting to the retaining members, a spring member extending outwardly from the lock body and in contact with the bottom wall at least one boss extending outwardly from the lock body, and a lock boss extending outwardly from the lock body through the top wall, and a button including at least one arm member, the at least one arm member defining a slot for receiving the at least one boss.

8. The push latch mechanism as set forth in claim 7, wherein the at least one arm member defines a snap member.

9. The push latch mechanism as set forth in claim 8, wherein the snap member defines a contact surface for containing the at lest one boss.

10. The push latch mechanism as sat forth in claim 7, wherein the button include two arm members, each arm member defining a slot and a snap member.

11. The push latch mechanism as set forth in claim 10, wherein the lock body defines two opposing bosses.

12. The push latch mechanism as set forth in claim 7, wherein the top wall defines a notch formed in the top wall.

13. The push latch mechanism as set forth in claim 7, wherein the spring member extends angularly outwardly from the lock body and effects rotational movement of the lock body about the rod.

14. A push latch mechanism for use in an automobile comprising:

a housing defining a top wall, a bottom wall, and a back wall, the beck wall further defining retaining members extending outwardly from the back wall, a lock defining a lock body, the lock body further defining a rod for mounting to the retaining members, a spring member extending outwardly from the lock body and in contact with the bottom wall, two opposing bosses extending outwardly from the lock body, and a lock boss extending outwardly from the lock body through the top wall, and a button including two arm members, each of the two arm members defining a slot for receiving the bosses.

15. The push latch mechanism as forth in claim 14, wherein each of the two arm members defines a snap member.

16. The push latch mechanism as set forth in claim 15, wherein each of the snap defines an contact surface for containing the bosses in the slots.

17. The push latch mechanism as set forth in claim 14, wherein the lock boss defines an inclined surface.

18. The push latch mechanism as set forth in claim 16, wherein each of the snap members is flexible and defines an inclined surface for permitting the insertion of the bosses into the slot.

19. The push latch mechanism as set forth in claim 14, wherein the spring member extends angularly outwardly from the lock body and effects rotational movement of the lock body about the rod.

* * * * *